US006018130A

United States Patent [19]

Haack et al.

[11] Patent Number: 6,018,130

[45] Date of Patent: Jan. 25, 2000

[54] ROLL-OVER SENSOR WITH PENDULUM MOUNTED MAGNET

[75] Inventors: David P. Haack; Brad A. Benson; Daniel R. Reneau, all of Madison, Wis.

[73] Assignee: Breed Automotive Technology, Inc., Lakeland, Fla.

[21] Appl. No.: 09/178,120

[22] Filed: Oct. 23, 1998

Related U.S. Application Data

[63] Continuation-in-part of application No. 09/082,046, May 20, 1998, Pat. No. 5,955,714.

[51] Int. Cl.[7] ..... H01H 35/02

[52] U.S. Cl. ..... 200/61.52; 200/61.45 M; 200/61.45 R; 335/205; 335/206; 335/207

[58] Field of Search ..... 335/205–207; 200/61.45 M, 61.45 R, 61.52

[56] References Cited

U.S. PATENT DOCUMENTS

| | | |
|---|---|---|
| 3,051,805 | 8/1962 | Binford . |
| 3,180,952 | 4/1965 | Preisz . |
| 3,327,079 | 6/1967 | Widl . |
| 3,725,896 | 4/1973 | Wagner . |
| 3,737,599 | 6/1973 | Zuvela . |
| 3,778,572 | 12/1973 | Matsui et al. . |
| 3,795,780 | 3/1974 | Lawrie . |
| 3,814,875 | 6/1974 | Takada . |
| 4,016,535 | 4/1977 | Dinlocker . |
| 4,103,842 | 8/1978 | Martin et al. . |
| 4,258,353 | 3/1981 | Carlson . |
| 4,275,391 | 6/1981 | Okamura . |
| 4,726,627 | 2/1988 | Frait et al. . |
| 4,820,888 | 4/1989 | Shields . |
| 4,866,379 | 9/1989 | Odagawa et al. . |
| 4,910,459 | 3/1990 | Odagawa et al. . |
| 5,010,216 | 4/1991 | Sewell et al. . |
| 5,149,926 | 9/1992 | Ono . |
| 5,237,134 | 8/1993 | Thuen et al. . |
| 5,248,861 | 9/1993 | Kato et al. . |
| 5,283,402 | 2/1994 | Green . |
| 5,285,031 | 2/1994 | Schueneman . |
| 5,285,032 | 2/1994 | Robinette . |
| 5,293,523 | 3/1994 | Posey . |
| 5,307,699 | 5/1994 | Engdahl et al. . |
| 5,373,124 | 12/1994 | Abendroth et al. . |
| 5,378,865 | 1/1995 | Reneau . |
| 5,416,293 | 5/1995 | Reneau . |
| 5,450,049 | 9/1995 | Bachmann . |
| 5,581,060 | 12/1996 | Kobayashi et al. . |
| 5,664,665 | 9/1997 | Kobayashi et al. . |
| 5,955,714 | 9/1999 | Reneau ..... 200/61.52 |

*Primary Examiner*—Lincoln Donovan
*Assistant Examiner*—Tuyen T. Nguyen
*Attorney, Agent, or Firm*—Patrick Stiennon; Lonnie Drayer

[57] ABSTRACT

A shunt is pivotally mounted to form a pendulum positioned between a reed switch and a magnet. The shunt is formed of ferromagnetic material and is mounted such that as long as it remains between the reed switch and the magnet the reed switch remains open. The shunt is held or biased between the magnet and the reed switch by the force of the magnetic attraction between the shunt and the magnet. The mass of the shunt acts as both a tilt sensor which responds to gravity and an accelerometer sensitive to crash-induced accelerations. The reed switch, magnet and shunt are mounted in a housing which positions the reed switch and magnet and controls the maximum range of motion of the pendulum-mounted shunt. An alternative embodiment employs a subassembly which includes a magnet, a shunt, and a selectively positioned mass, the subassembly is mounted to pivot over a reed switch. The magnet is positioned on or very near the pivot axis. The shunt is positioned further from the pivot axis toward the reed switch. Rotation of the subassembly about the pivot axis results in little displacement of the magnet but a large displacement of the shunt which allows the reed switch to be influenced by the magnet and close. The frequency response and sensitivity of the subassembly can be adjusted by positioning mass about the pivot axis so as to achieve a desired first and second moments about the pivot axis.

28 Claims, 8 Drawing Sheets

ROLL-OVER SENSOR WITH PENDULUM MOUNTED MAGNET

CROSS REFERENCES TO RELATED APPLICATIONS

This application is a continuation-in-part of U.S. application Ser. No. 09/082,046 filed May 20, 1998, now U.S. Pat. No. 5,955,714 the disclosure of which is incorporated by reference herein.

STATEMENT AS TO RIGHTS TO INVENTIONS MADE UNDER FEDERALLY SPONSORED RESEARCH AND DEVELOPMENT

BACKGROUND OF THE INVENTION

The present invention relates to shock sensors in general and to shock sensors used for engaging or deploying automobile safety devices in particular.

Shock sensors are used in motor vehicles, including cars and aircraft, to detect vehicle collisions. When such a collision occurs, the shock sensor triggers an electronic circuit for the actuation of one or more safety devices. One type of safety device, the deployable air bag, has found widespread acceptance by consumers as improving the general safety of automobile operation. Air bags have gone from an expensive option to standard equipment in many automobiles. Further, the number of air bags has increased from a single driver's side air bag to passenger air bags. Future use of multiple air bags is a distinct possibility.

With the ever increasing utilization of air bags, research and development has continued with efforts to make air bags and the electronics and sensors which control their deployment both more reliable and of lower cost. A key aspect of reliability with respect to air bags involves the twin, somewhat conflicting, requirements that the air bag deploy in every situation where deployment would be advantageous to the passengers but, at the same time, not deploy except when actually needed. Reliable deployment of an air bag without unwanted deployments is facilitated by use of multiple sensors in combination with actuation logic which can assess the nature and direction of the crash as it is occurring and, based on preprogrammed logic, make the decision whether or not to deploy the air bag. This increase in reliability tends to lead to a greater number of sensors as well as increased use of electronic logic.

The desire to hold down sensor cost and to keep the sensor integrated with the logic circuits has led to the use of solid state shock sensors. However, solid state shock sensors are prone to losing touch with the real world and may occasionally indicate a crash is occurring due to radio frequency interference, electronic noise, cross-talk within the electronics, etc.

The ability of mechanical shock sensors as an integral part of bag deployment systems to prevent unnecessary bag deployment has kept demand for mechanical shock sensors high.

A number of types of shock sensors employing reed switches have been particularly advantageous in combining a mechanical shock sensor with an extremely reliable electronic switch which, through design, can be made to have the necessary dwell times required for reliable operation of vehicle safety equipment. The reed switch designs have also been of a compact nature such that the switches may be readily mounted on particular portions of the vehicle which, in a crash, will experience a representative shock which is indicative of the magnitude and even the direction of the shock-inducing crash.

Typically, shock sensors have sensed crash magnitude and direction. Information about the type of crash a vehicle is experiencing is then used by safety equipment logic to deploy air bags or retract seat belts, etc. One result of a vehicle crash or accident can be an overturning, or roll-over, of the vehicle. Such events may be preceded by a side impact or may be the result of a loss of control of the vehicle. In either case a side crash load may or may not be detected prior to the vehicle entering a roll. If safety equipment logic is to consider the implications of vehicle roll-over in deploying safety equipment, then sensors must be provided which can reliably indicate a roll-over has occurred or is occurring. Typically integrated accelerometers and rate sensors are employed to characterize vehicle dynamics. However, such solid state devices are subject to electromagnetic interference.

What is needed is a mechanical roll-over sensor.

SUMMARY OF THE INVENTION

A shunt is pivotally mounted to form a pendulum positioned between a reed switch and a magnet. The shunt is formed of ferromagnetic material and is mounted such that as long as it remains between the reed switch and the magnet the reed switch remains open. The shunt is held or biased between the magnet and the reed switch by the force of the magnetic attraction between the shunt and the magnet. The mass of the shunt acts as both a tilt sensor which responds to gravity and an accelerometer sensitive to crash-induced accelerations. The reed switch, magnet and shunt are mounted in a housing which positions the reed switch and magnet and controls the maximum range of motion of the pendulum-mounted shunt.

An alternative embodiment employs a subassembly which includes a magnet, a shunt, and selectively positioned mass, the subassembly is mounted to pivot over a reed switch. The magnet is positioned on or very near the pivot axis, whereas the shunt is positioned further from the axis toward the reed switch. Rotation of the subassembly about the pivot axis results in little displacement of the magnet but a large displacement of the shunt which allows the reed switch to be influenced by the magnet, so that the reed switch is actuated. The inertia and restoring force due to gravity and the frequency response of the subassembly can be adjusted by positioning mass about the pivot axis so as to achieve a desired first and second moments about the pivot axis.

It is a feature of the present invention to provide an electromechanical sensor which can detect vehicle roll-over and crash shocks leading to vehicle roll-over.

It is a further feature of the present invention to provide a sensor for detecting vehicle roll-over which is less sensitive to electromagnetic interference.

It is another feature of the present invention to provide a shock sensor for use in a vehicle safety system.

It is a yet further feature of the present invention to provide a sensor which incorporates a pivoting mass which can readily be adjusted both in center of gravity and moment of inertia to tailor the sensor response to shock and tilting.

Further objects, features and advantages of the invention will be apparent from the following detailed description when taken in conjunction with the accompanying drawings.

DESCRIPTION OF THE PREFERRED EMBODIMENTS

Figure 2:
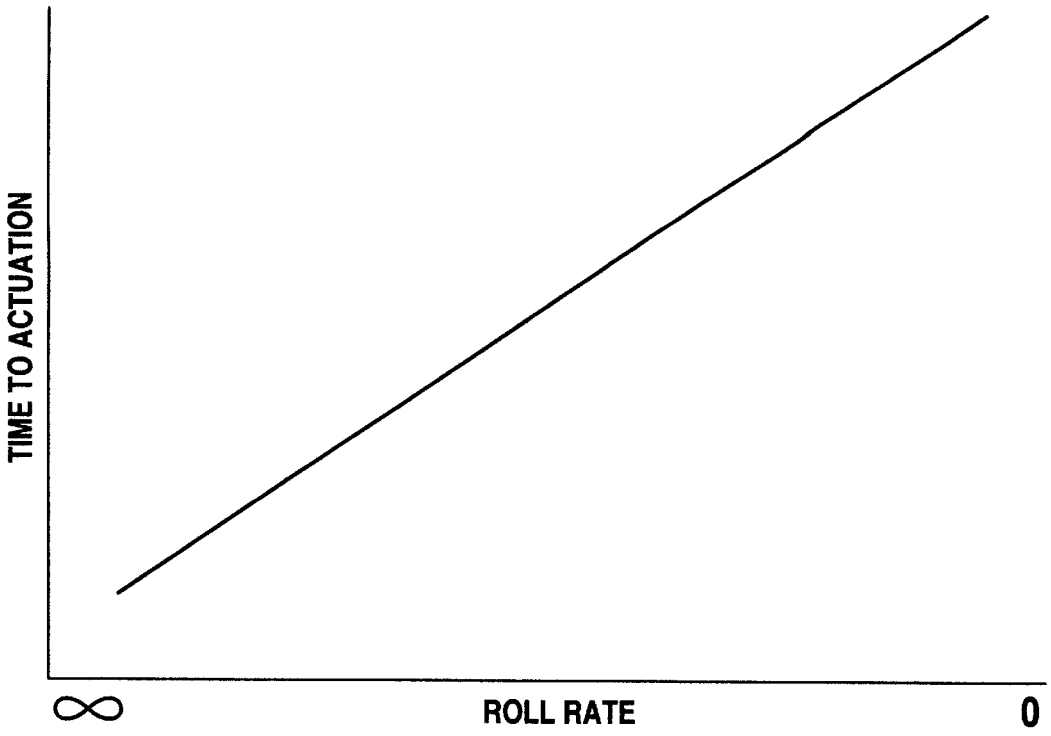
FIG. 2 is a graph of time to actuate vs. roll rate.
Figure 3:
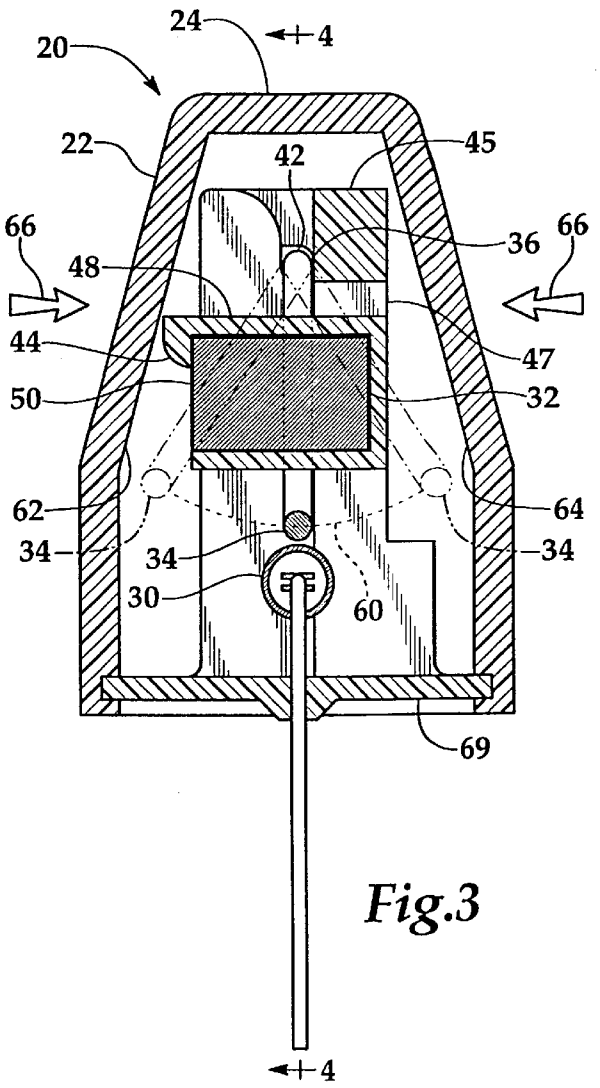
FIG. 3 is a cross sectional view of the sensor of FIG. 1, taken perpendicular to the axis of the reed switch and through the centerline of the device.
Figure 4:
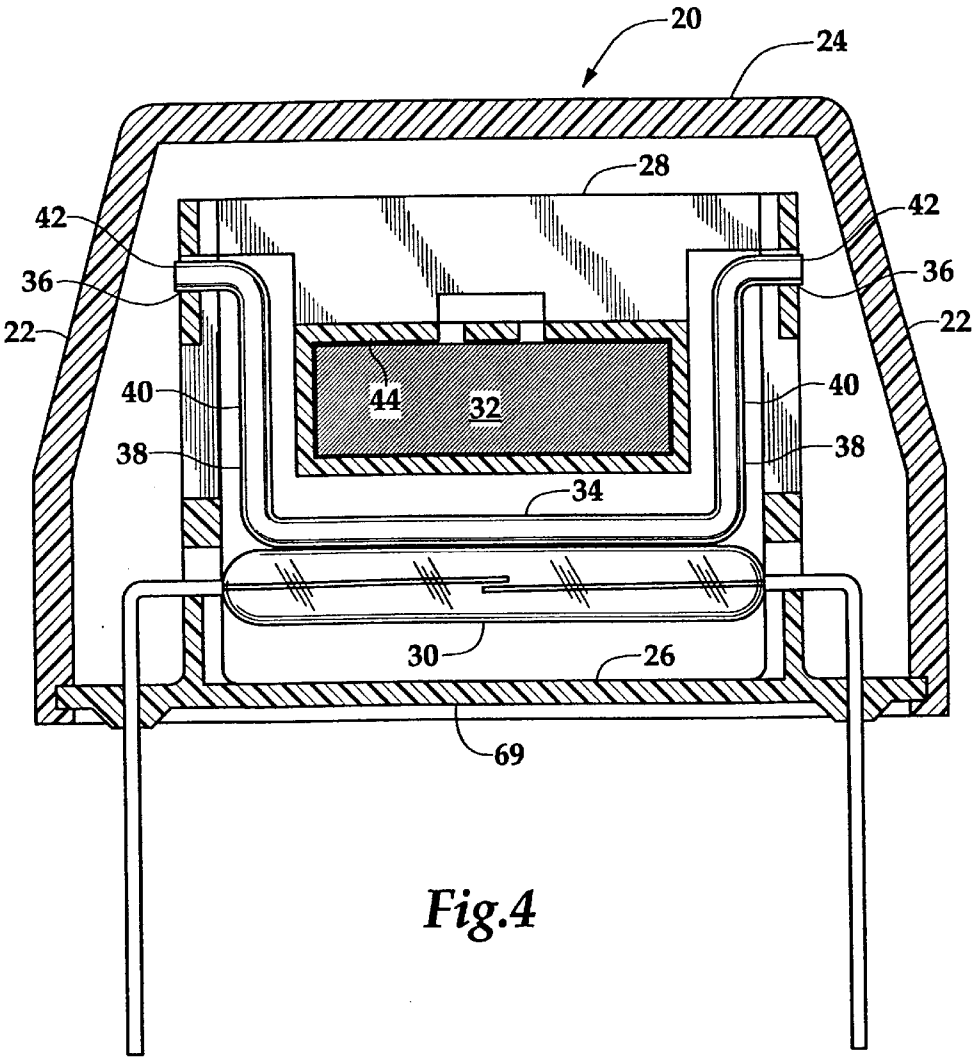
FIG. 4 is a cross-sectional view of the device of FIG. 3, taken along section line 4—4.

Referring more particularly to FIGS. 1–16, wherein like numbers refer to similar parts, a tilt sensor 20 is shown in FIGS. 3 and 4. The tilt sensor 20 has a plastic housing 22 which is composed of a base 26 and connected magnet housing 28 both enclosed within a cover 24. The functional components of the tilt sensor 20 are a reed switch 30 fixed to the housing, a magnet 32 positioned above the reed switch 30, and a shunt 34 which is hung from pivot points 36 on the housing defined between the connected base 26 and the magnet housing 28. The shunt 34 hangs in a neutral position between the reed switch 30 and the magnet 32 when the sensor 20 is in a vertical position as shown in FIG. 3.

The housing 22 and its components are constructed of plastic, although the cover 24 could incorporate a magnetic shield. The shunt 34 may be formed as part of a trapeze member 38, consisting of the shunt member 34 which is a horizontal bar, and two vertical pendulum arms 40 terminating at coaxial pivot portions 42. The shunt 34 is constructed of ferromagnetic material, for example an alloy similar to that of which reed switch reeds are constructed. The ferromagnetic shunt 34 prevents the magnetic field produced by the magnet from causing the reed switch 30 to close.

The shunt 34 is held between the reed switch 30 and the magnet 32 by gravity and magnetic attraction between the shunt 34 and the magnet 32. A force produced by gravity when the tilt sensor 20 is tilted or by a shock with a component perpendicular to an axis defined by the pivot points 36 can cause the shunt 34 to pivot about the pivot portions 42 of the trapeze member 38. Pivoting of the trapeze member 38 causes the shunt 34 to move out from between the reed switch 30 and the magnet 32 which allows the magnetic field produced by the magnet to cause the reed switch to close.

For simplicity of construction, the entire trapeze member 38 can be constructed of a ferromagnetic material but it is preferable to have only the shunt 34 constructed of ferromagnetic material and the other portions of the trapeze member 38 constructed of copper or other nonmagnetic material.

Figure 1:
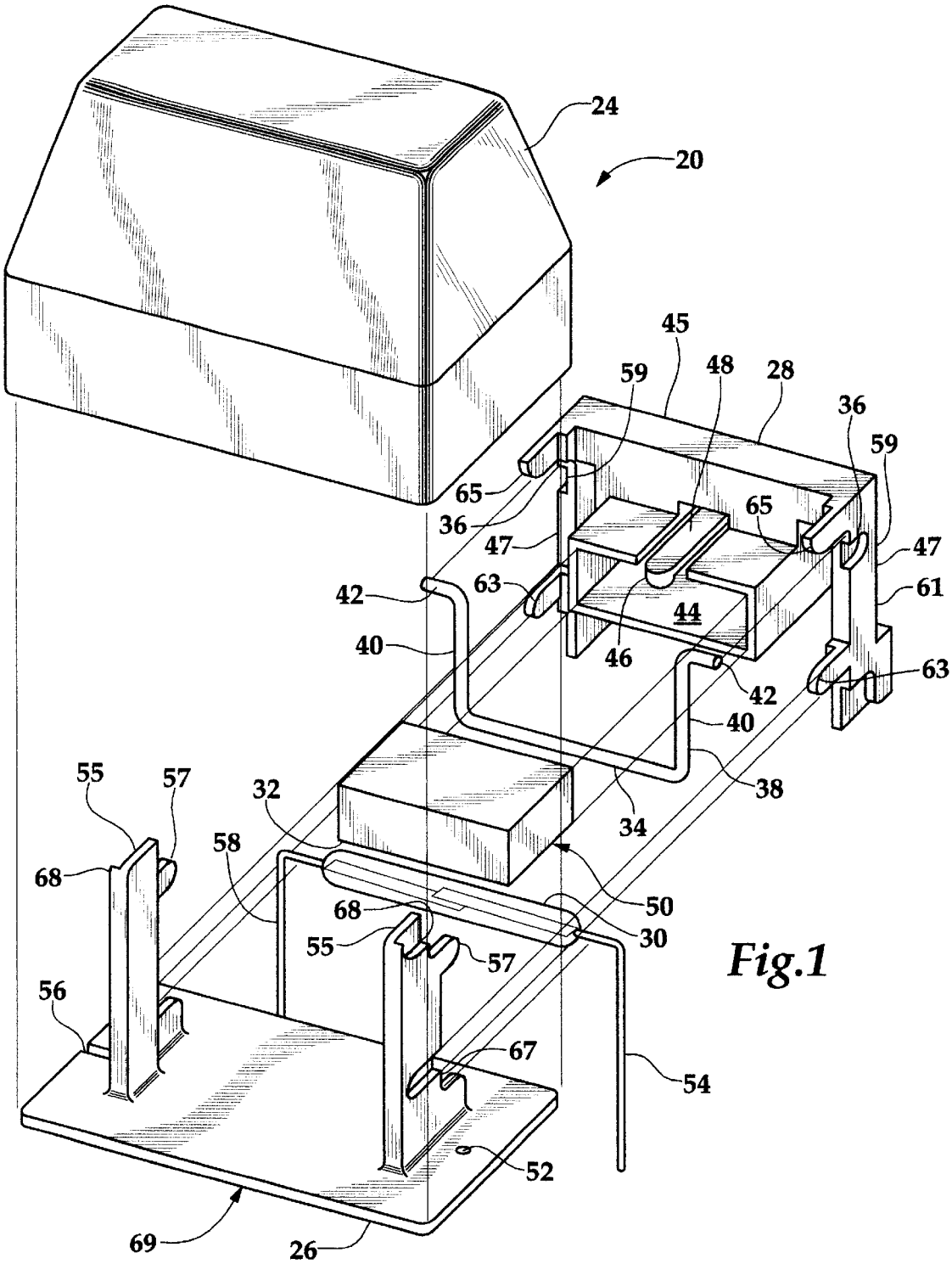
FIG. 1 is an exploded perspective view of the sensor of this invention.

As shown in FIG. 1, the magnet 32 is retained on the magnet housing 28 in a pocket 44. The pocket 44 depends from a cross beam 45 which is elevated above the base on two vertical supports 47. This overhead support of the pocket 44 allows the shunt 34 to swing freely on the pendulum arms 40 from out between the reed switch and the magnet in two opposite directions, making the sensor 20 capable of bi-directional activation. A resilient clip 46 is integral with the magnet housing 28 and has a resilient arm 48 which holds the magnet within the pocket 44. The magnet 32 has two poles aligned along the axis defined by the reed switch, and both poles are on the face 50 of the magnet 32 facing the reed switch 30.

The base 26 has a lead hole 52 through which the first reed switch lead 54 passes. A slot 56 opposite the lead hole 52 receives the second lead 58 of the reed switch 30. Thus, the lead hole 52 together with portions of the base 26 and magnet housing 28 position the reed switch 30 with respect to the shunt 34 and the magnet 32. The leads 54, 58 allow the sensor 20 to be directly mounted to a circuit board (not shown).

The base 26 has two upstanding arms 55. Each arm has a projecting thumb 57 which mates with a slot 59 in the magnet housing 28. The thumbs 57 define supports on which the coaxial portions 42 of the trapeze 38 pivot. The magnet housing 28 has two vertical legs 61 which have lower tabs 63 and upper tabs 65 which mate with corresponding lower slots 67 and upper slots 68 which accurately position and lock together the magnet housing 28 and the base 26. The interlocking features of the base 26 and the magnetic housing 28 hold the base 26 and magnetic housing 28 together until the cover 24 is installed. The cover 24 surrounds and holds together the base 26 and the magnet housing 28. A tight fit between the cover 24 and the bottom 69 of the base 26 forms a recess, as shown in FIGS. 3 and 4, which is filled with epoxy to seal and connect the bottom 69 to the cover 24.

Operation of the sensor 20 requires a balance between magnetic sensitivity of the reed switch 30, the strength of the magnet 32, the size and mass of the shunt 34, the length of the pendulum arms 40 and the geometric spacing between components. The pendulum mass, which as illustrated is coincident with the shunt 34, controls the force produced by gravity attempting to pivot the shunt 34 along an arc 60 shown in FIG. 3 when the housing is tilted so that gravity causes the pendulum to swing out along the arc 60. The inner walls 62, 64 of the housing cover form stops which limit the maximum travel of the shunt 34.

The sensor 20 will typically be employed together with integrated chip sensors which are executed in silicon lithography. Integrated chip sensors can accurately detect linear and angular accelerations. However, they are subject to spurious signals produced by electromagnetic interference and other sources of stray voltages. The sensor 20 provides both an indication of vehicle tilt and angular acceleration which is less subject to spurious outputs. By combining information from mechanical and integrated circuit devices a better understanding of vehicle dynamics can be produced.

FIG. 2 shows how a sensor such as the one shown in FIGS. 1, 3, and 4 might be designed to react to angular accelerations such as produced by forces aligned with arrows 66 as shown in FIG. 3. As the roll rate approaches zero a response time exists for angular displacement, as roll rate approaches infinity, time to activation approaches zero limited to a predetermined extent by an amount of damping presented by friction, gas or fluid within the housing.

In situations where a vehicle rolls over, the actual roll-over may or may not be preceded by a shock load such as is produced by an impact. Thus the advantage of a sensor which can directly measure vehicle tilt as well as side impact. Because of the relationship between angular rate and activation time as shown by FIG. 4, an angular rate of an integrated chip sensor can be directly compared to activation time for the electromechanical sensor 20.

Figure 5:
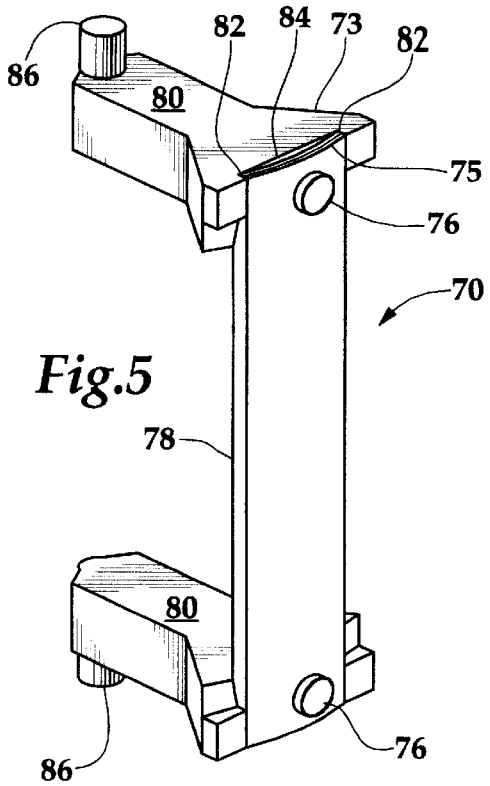
FIG. 5 is an isometric view of an alternative embodiment trapeze member.

An alternative embodiment trapeze member 70, shown in FIG. 5, is constructed by forming a copper alloy powder metallurgy part 73 onto which are pressed two layers 75 of stamped magnetic shunt material. Two posts 76 extend from a bar 78 which joins two pivot arms 80 and the shunt layers 75 are press-fit over the posts 76 and between the sides 82 of a groove 84 formed in the bottom of the bar 78. Alternatively, the shunt layers 75 may form bar 78, in that case the posts 76 would extend from grooves 84 in the bottom of parts 73. The trapeze member 70 has two axially aligned posts 86 which form the pivotal mounting for the trapeze member 70. The trapeze member 70 can easily accommodate varying the center of gravity and the moment of inertia about an axis which passes through the aligned posts 86 by varying the mass distribution within the arms 80 and the bar 78 joining the arms.

Figure 6:
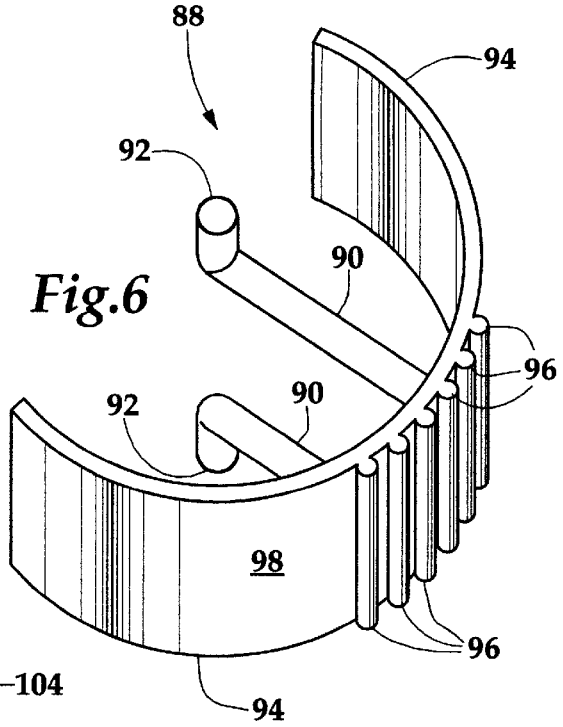
FIG. 6 is an isometric view of a further embodiment trapeze member.

Another alternative embodiment trapeze member 88 is shown in FIG. 6. The trapeze member 88 has two pivot arms 90, which terminate in axially aligned posts 92. The pivot arms 90 are joined to a portion of a cylindrical shell 94 which forms the majority of the pendulum mass of the trapeze member 88. The shell 94 extends axially about the axis defined by the posts 92. The shunt is formed by a series of wires 96 welded to an outer surface 98 of the shell 94. The shell 94 can be varied in circumferential extent to increase the mass and the moment of inertia of the trapeze member 88. The cylindrical shell 94 is shown with a circumferential extent of about two hundred and ten degrees, the circumferential extent can vary from approximately one hundred and eighty degrees to about two hundred and seventy degrees. The trapeze member 88 is formed as a stamping, while the bent wires which form the pivot arms 90 are welded to the stamped shell 94 onto which the shunt wires 96 are welded.

Figure 7:
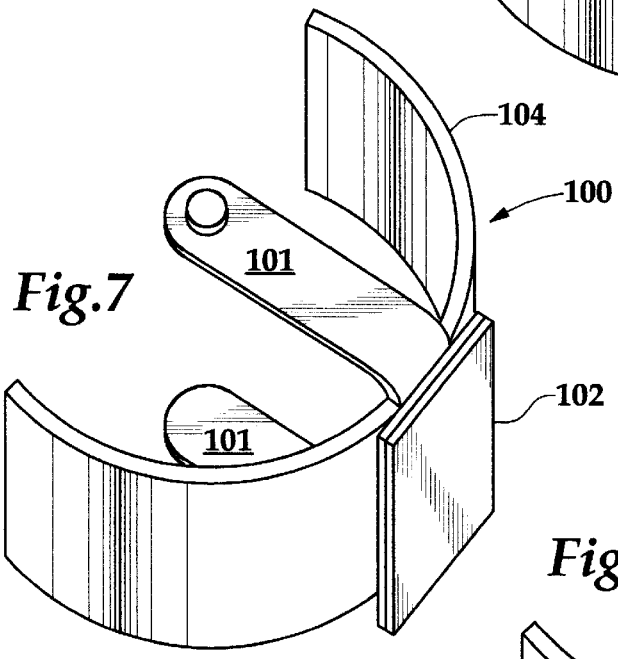
FIG. 7 is an isometric view of a yet further embodiment trapeze member.

Another alternative embodiment trapeze member 100, shown in FIG. 7, is also designed to be formed as a metal stamping. The trapeze member 100 is similar to that shown in FIG. 6, except that the pivot arms 101 are co-formed with a semi-cylindrical mass 104. The shunt is constructed of two layers 102 of magnetically permeable material welded to the semi-cylindrical stamping 104.

Figure 8:
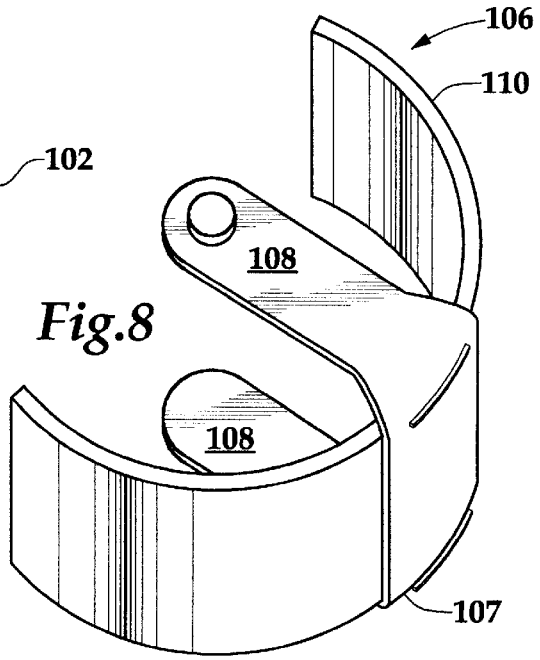
FIG. 8 is an isometric view of a still further embodiment trapeze member.

Yet another alternative embodiment trapeze member 106, shown in FIG. 8, has pivot arms 108 and a shunt 107 which are formed as a single stamping of magnetically permeable material. The single piece pivot arm 108 and shunt 107 is attached to a semi-cylindrical shell 110 formed of a second stamping of nonmagnetic material, for example copper, to thus form the trapeze member 106.

Figure 9:
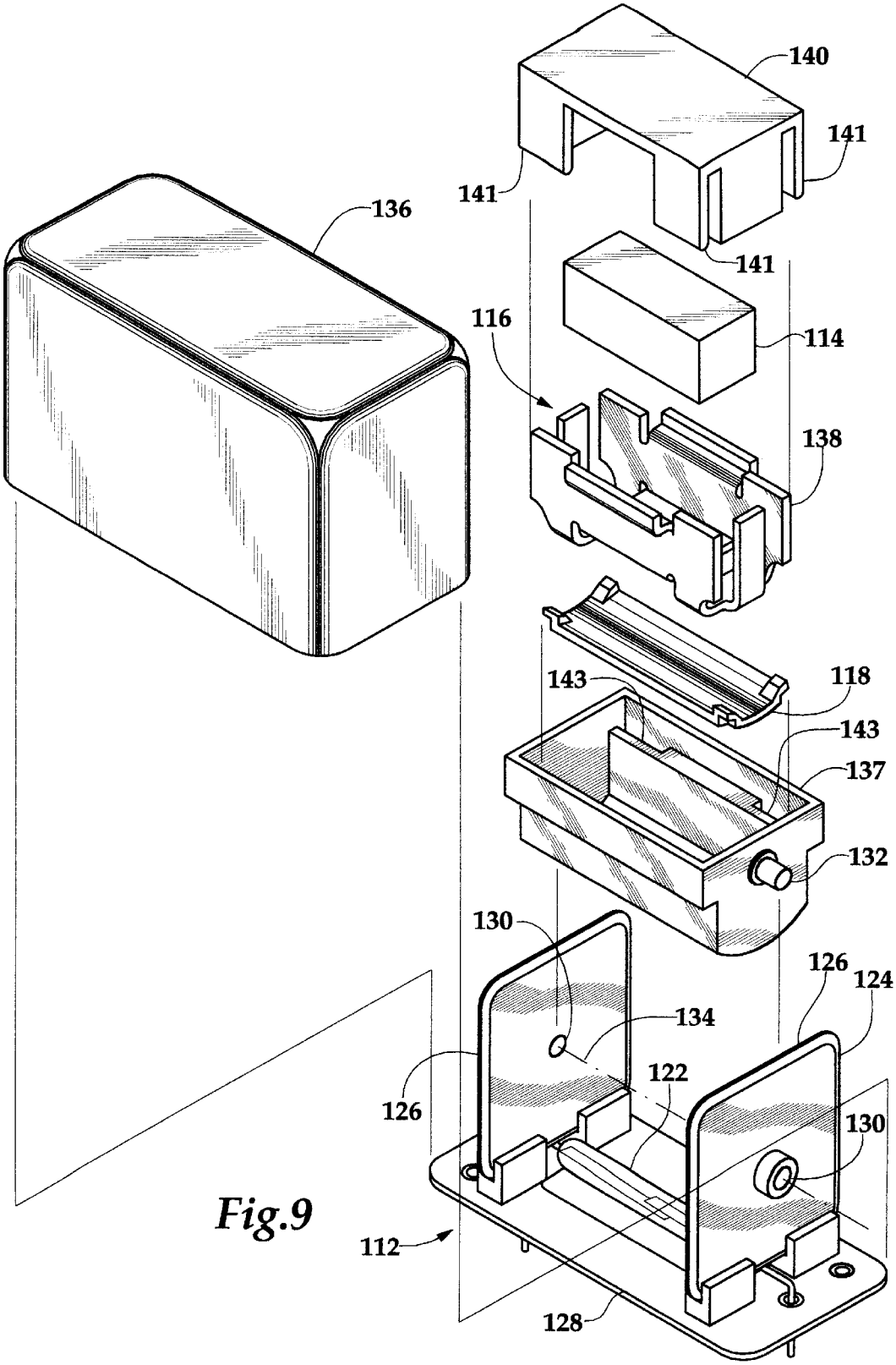
FIG. 9 is an exploded isometric view of an alternative embodiment of the sensor of this invention.

A tilt sensor 112, shown in FIG. 9, incorporates a magnet 114 in a pivot member 116. The pivot member 116 has a metal shunt 118 which is pivotally mounted on a housing 124. The shunt 118 is positioned over a reed switch 122 which in turn is mounted to a housing 124. The housing 124 has two ends 126 which are mounted to the base 128 of the housing 124. The ends 126 have portions forming receptacles 130 which receive pivot posts 132 mounted to the pivot member 116. The receptacles 130 define a pivot axis 134 about which the pivot member rotates. The pivot member 116 is contained within a housing cover 136 which engages the base 128 and the ends 126. Ridges (not shown) on the inside of the case position the ends 126 and the base 128 with respect to the housing cover 136.

The magnet 114 is positioned within a metal stamping 138 formed of a dense nonmagnetic material such as copper. The magnet 114 and the metal stamping 138 are disposed over the shunt 118 within a plastic body 137. A plastic cover 140 has stakes 141 which extend downwardly through upwardly opening slots 143 in the plastic body 137. The stakes 141 are deformed by heat to lock the cover 140 to the plastic body 137.

The tilt sensor 112 combines the sensing mass, the shunt 118, and the magnet 114 in a single unit. Because the magnet 114 is located at the pivot axis defined by the pivot posts 132, rotation of the magnet 114 about the pivot axis does not substantially change the geometry between the magnet 114 and the reed switch 122. However, rotation of the pivot member 116, and the shunt 118 mounted therein, changes the geometric relationship between the shunt 118, the reed switch 122, and the magnet 114. The shunt 118 effectively moves out from between the magnet 114 and the reed switch 122 allowing the magnetic field produced by the magnet 114 to cause the reed switch 122 to close. As the pivot member 116 rotates about the pivot axis 134, the magnet 114 which is mounted substantially symmetrically about the axis 134 rotates but does not move away from it's position relative to the reed switch 122. The shunt 118 because it is spaced from the pivot axis 134, rotates away from a line connecting the pivot axis 134 and the reed switch 122, thus allowing the magnet 114 which is mounted about the axis 134 to close the reed switch 122.

By combining the pendulum mounted mass and the magnet and shunt, the magnet does double duty, contributing to the pendulum mass as well as providing the magnetic field which activates the reed switch. The interaction of the magnet with the reed switch also has a damping effect as the magnet interacts with the magnetically permeable material of the reeds which make up the reed switch.

Figure 10:
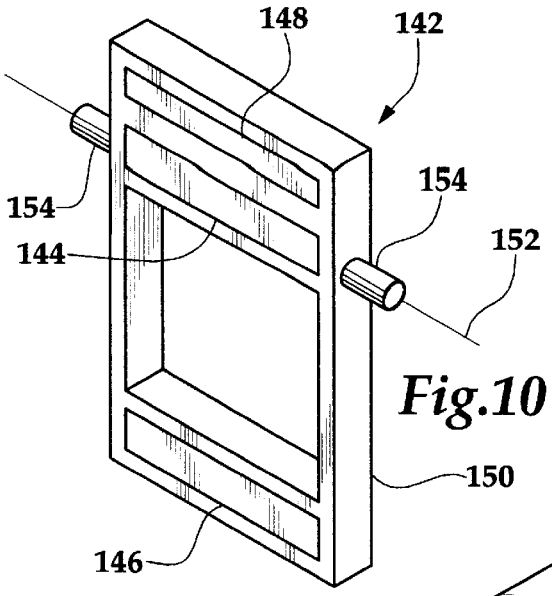
FIG. 10 is an isometric view of an alternative trapeze member in which the magnet is mounted on the trapeze.

FIG. 10 shows a simplified pivot member 142 which incorporates a magnet 144, a shunt 146, and a counterweight 148 mounted on a frame 150 to pivot about a pivot axis 152 defined by pivot posts 154. This illustrates the concept of employing a pivot member 142 in which the shunt 146, the magnet 144, and the mass are placed about a pivot axis 152 which is positioned above a reed switch (not shown). By varying the amount and placement of the components and additional mass represented by the counterweight 148, the center of gravity, or first moment about the axis 152, and the moment of inertia, also known as the second moment about the axis 152, can be independently optimized to achieve the desired sensitivity and response to tilt and lateral shock loads. The pivot member 142 is disposed within a housing (not shown) to pivot above a reed switch (not shown) running parallel to the axis defined by the pivots 154 and positioned beneath the shunt 146.

Figure 11:
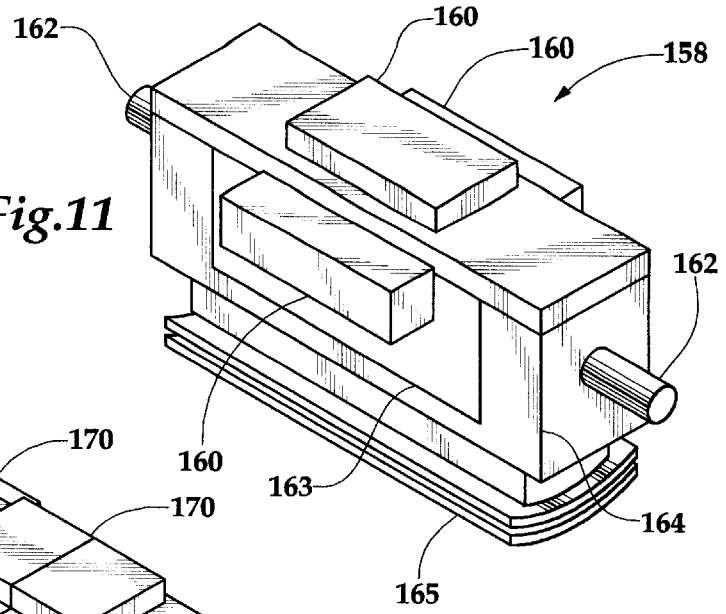
FIG. 11 is an isometric view of a further alternative embodiment trapeze member in which the magnet is mounted on the trapeze.

Another pivot member 158, shown in FIG. 11, illustrates the arrangement of a magnetic shunt 165 and discrete sections 160 of mass positioned about an axis defined by pivot posts 162. The mass forming the frame 164 may also be designed to position mass and the magnet 163 to achieve a desired center of gravity and moment of inertia. The frequency of the pendulum defined by the pivot member 158 is controlled by the length of the pendulum arm. The pendulum arm length is the distance between the pivot axis and the center of gravity. Frequency response may thus be adjusted, that is designed, to increase sensitivity to roll-over events, versus side impact events, or vice versa. Frequency response may also be varied by design to avoid coupling between the response of the sensor and a particular frequency which might arise due to vehicle dynamics.

The moment of inertia about the pivot axis, which is defined as the integration of each unit mass times the square of its mean distance from the pivot axis, controls the amplitude of any resulting motion of the pivot member 158 in response to an input shock. A greater moment of inertia can serve to control the minimum shock necessary to cause sufficient motion of the pivot member 158 to actuate the reed switch. Thus there is an interaction between the fundamental period of the pivot member, the moment of inertia of the pivot member, and the shape of the shunt, and the damping characteristics of the system, which may include magnetic, inductive and frictional damping. Typically each tilt sensor will be designed for a particular application based on a physics model of the device and the expected input shocks and loads. Following design, tilt sensors are tested in test fixtures, and finally in actual vehicle crash tests.

Figure 12:
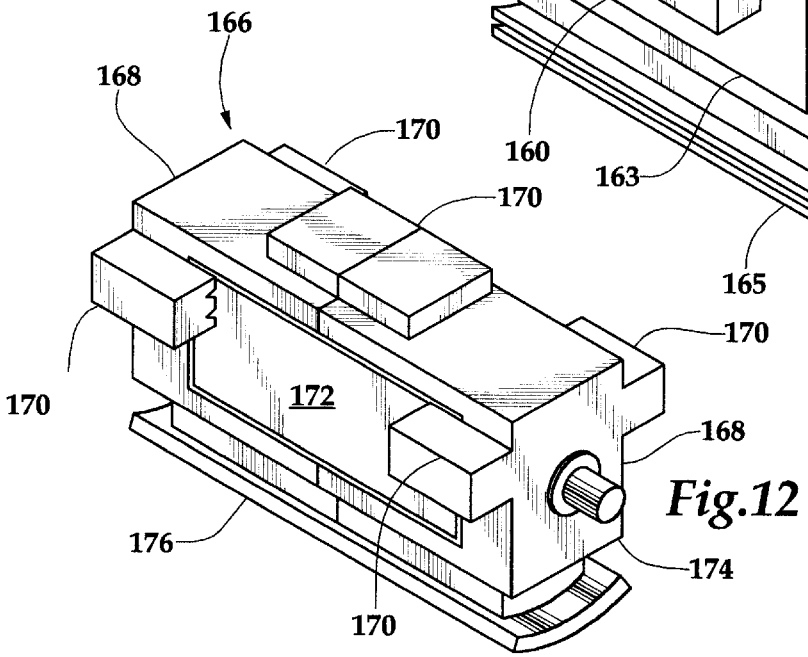
FIG. 12 is an isometric view of the trapeze member of FIG. 1 I wherein the member is formed from two molded halves.

FIG. 12 illustrates a pivot member 166 which is constructed of two identical powder metallurgy injection molded pieces 168. The pieces 168 have mass adjustment portions 170 some of which also function to capture the magnet 172 on the frame 174 formed by the injection molded pieces 168. A stamped shunt 176 is welded to the two molded pieces 168 and the molded pieces 168 are welded to each other.

Figure 13:
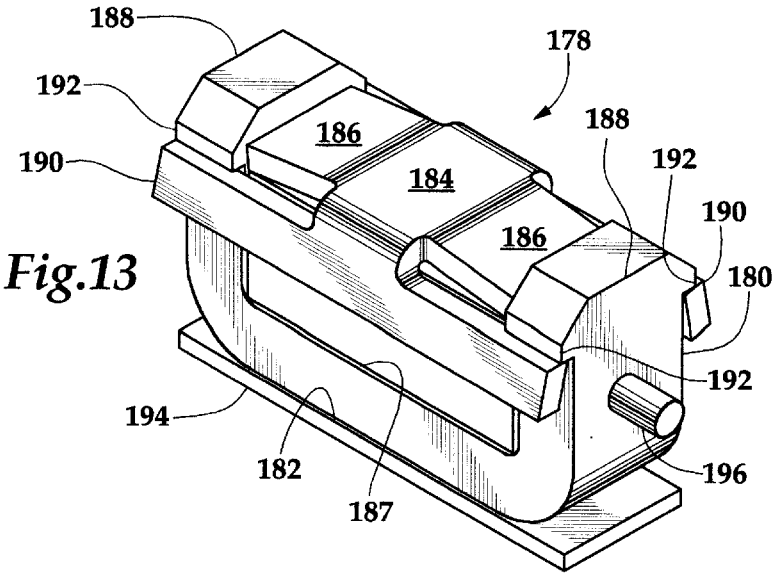
FIG. 13 is an isometric view of a further embodiment trapeze member of this invention.

A further embodiment pivot member 178 is illustrated in FIG. 13. The member 178 has a frame 180 which is formed of a stamped base 182 which interlocks with a top member 184. The top member 184 has spring flanges 186 which press against a magnet 187, held between upturned arms 188. The spring flanges draw locking bars 190 against locking tabs 192. The shunt 194 is welded to the base 182. Pivot posts 196 are welded or press fit to the arms 188 of the base 182. Alternatively the top member 184 may be welded to the upturned arms 188.

Figure 14:
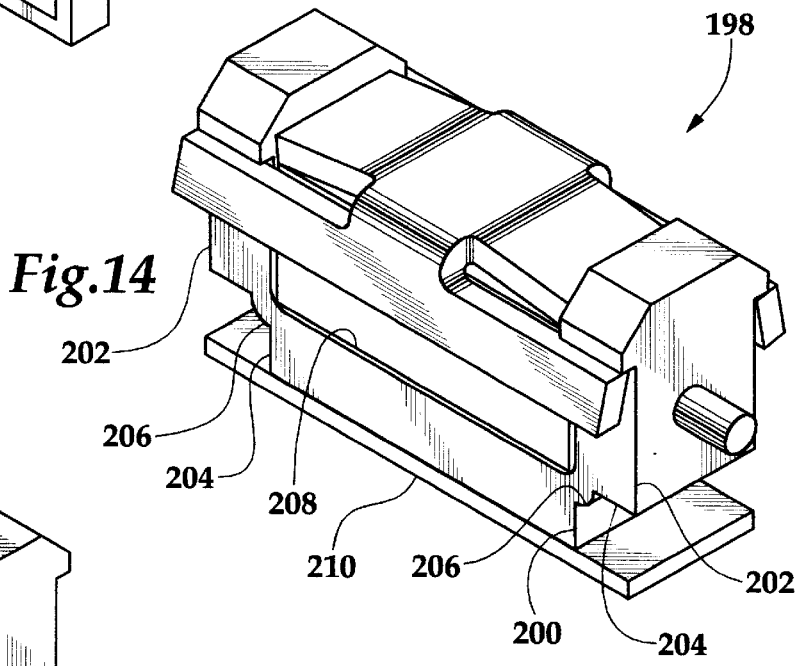
FIG. 14 is an isometric view of yet another embodiment of the trapeze member of this invention.

FIG. 14 shows an alternative embodiment pivot member 198 in which the base 200 is notched where upstanding arms 202 join the base. The notches 204 result in a smaller hinge 206 so that the base 200 and arms 202 can better engage against a magnet 208 and a shunt 210.

Figure 15:
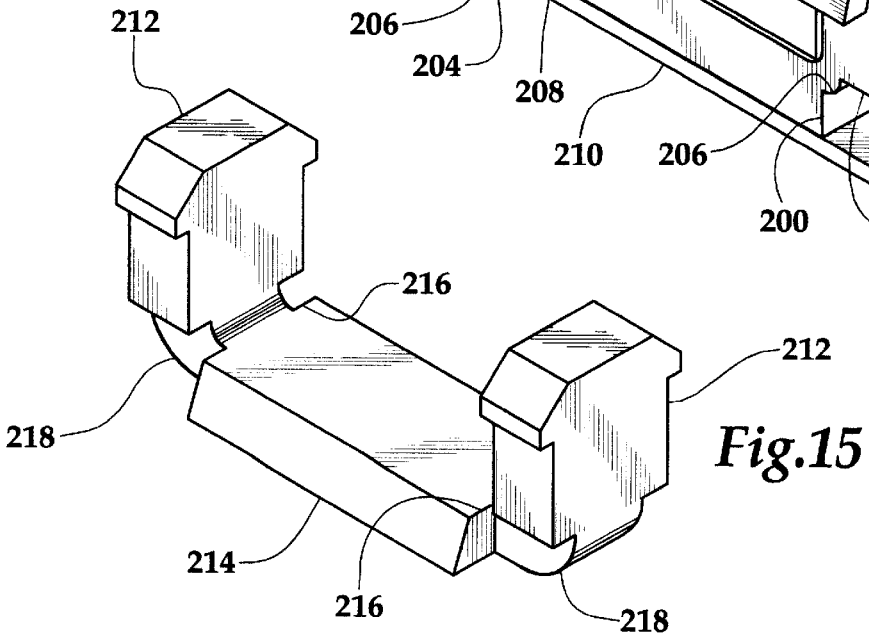
FIG. 15 is an isometric view of still another embodiment of the trapeze member of this invention.

FIG. 15 shows a still further approach to forming upstanding arms 212 on a base 214. Notches 216 are cut on either side of hinges 218 which have the full thickness of the base 214.

Figure 16:
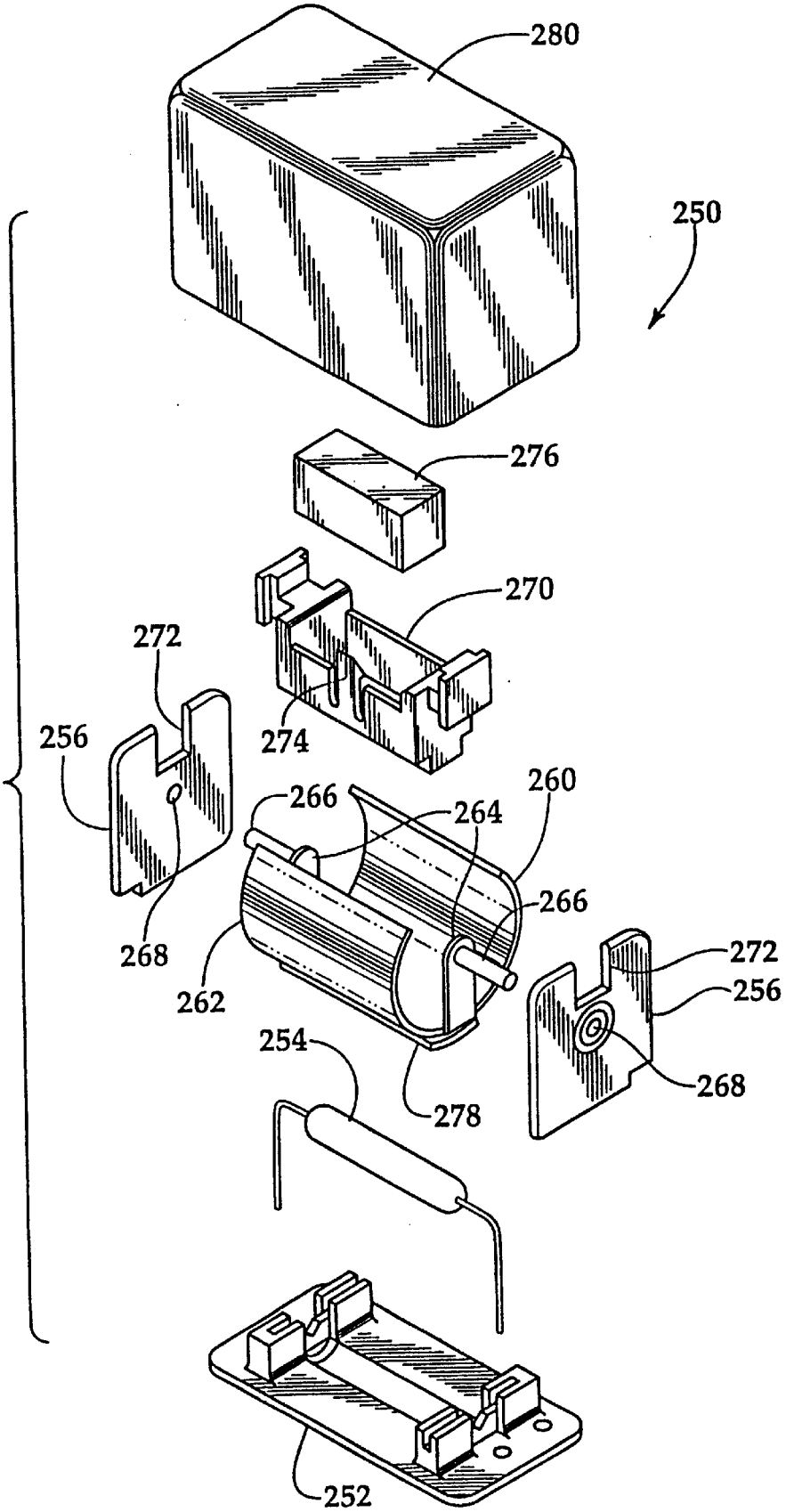
FIG. 16 is an exploded isometric view of another alternative embodiment tilt sensor of this invention.

Yet another alternative embodiment tilt sensor 250 of this invention is shown in FIG. 16. The tilt sensor 250 has a base 252 which receives a reed switch 254. Two plastic end wall segments 256 are received in a snap-fit relation to the plastic base 252. A pivot member 260 has a semicylindrical nonferromagnetic metal segment 262 with two parallel upstanding arms 264 from which pivot axles 266 extend. The pivot axles 266 are received in circular openings 268 defined in the end wall segments 256. A magnet housing 270, preferably formed of molded plastic, is engaged in a snap fit with upwardly opening slots 272 on the end wall segments 256. The magnet housing 270 has a resilient tab 274 which engages and retains a magnet 276 therein. The magnet housing 270 thereby fixes the magnet with respect to the housing independently of the position of the pivot member 260. The ferromagnetic shunt 278 is preferably in the form of a thin metal strip which is welded beneath the metal segment 262. A cover 280 overlies and encloses the housing.

It should be understood that the shunt 34 can be increased in size so as to continue to act as a shunt when displaced by a small angular motion of the trapeze. Further increasing the size of the shunt to increase its mass also serves to increase the force of gravity which acts to displace the shunt, relative to magnetic restoring forces, when the sensor is tilted.

It should be understood that the magnet may have varying arrangement and placement of poles and that the strength of the magnet may be varied. The magnet may be constructed of an AlNiCo alloy which exhibits a magnetic stability over a temperature range dictated by automobile application of the sensor.

It should also be understood that a spring, for example a torsion spring, could be positioned about one or both pivot points and could be used to supply additional restoring force to the shunt.

It is understood that the invention is not limited to the particular construction and arrangement of parts herein illustrated and described, but embraces such modified forms thereof as come within the scope of the following claims.

We claim:

1. A tilt sensor comprising:

a housing;

a reed switch mounted to the housing;

a pivot member pivotally mounted to the housing above the reed switch and defining a pivot axis about which the pivot member pivots, a magnet mounted to the housing above the reed switch;

a ferromagnetic shunt member positioned above the reed switch, the ferromagnetic shunt member being positioned on the pivot member, wherein the shunt member is thus mounted for swinging movement on the housing about the pivot axis between a position where the shunt member is interposed between the magnet and the reed switch, and an activated position where the shunt member is not interposed between the magnet and the reed switch, wherein the pivot member is mounted to the housing such that the shunt member may swing freely to move out of interposition between the magnet and the reed switch by travel in a first direction and a second opposite direction.

2. The tilt sensor of claim 1 wherein the magnet is mounted on the pivot member approximately at the position of the pivot axis so that the magnet rotates but does not substantially translate in response to swinging movement of the shunt member.

3. The tilt sensor of claim 1 wherein the magnet is fixedly mounted to the housing.

4. The tilt sensor of claim 1 wherein the pivot member has a trapeze with two pivot arms formed of nonmagnetic material.

5. The tilt sensor of claim 4 wherein the trapeze pivot arms are joined to a bar of nonmagnetic material and wherein the shunt is mounted to the bar.

6. The tilt sensor of claim 5 wherein the shunt is a planar metal stamping.

7. The tilt sensor of claim 5 wherein the shunt is a series of magnetic rods spaced circumferentially about the pivot axis and mounted to the bar.

8. The tilt sensor of claim 5 wherein the bar extends circumferentially about the pivot axis approximately 180 degrees so that the moment of inertia is increased.

9. The reed switch of claim 1 wherein the shunt member is biased, by magnetic attraction between the magnet and the shunt, in the position where it is interposed between the reed switch and the magnet.

10. The reed switch of claim 1 wherein the shunt member is mounted by two pendulum arms to the housing, and the magnet is located on the housing between the pendulum arms.

11. The reed switch of claim 1 wherein the housing comprises:

a base to which the reed switch is mounted;

a magnet housing to which the magnet is mounted, the magnet housing being connected to the base, and wherein pendulum arm pivot supports are defined by the base, the pendulum arms being pivotally mounted thereon; and a cover which encloses the connected base and magnet housing.

12. The reed switch of claim 1 wherein the housing has to end walls which extend upwardly from a base, and wherein the magnet is contained within a magnet housing which is connected to the end walls, and wherein the pivot member has a semicylindrical nonferromagnetic member, the magnet within the housing being positioned within the semicylindrical member.

13. A tilt sensor comprising:

a housing;

a reed switch mounted to the housing;

a pivot member pivotally mounted to the housing above the reed switch and defining a pivot axis about which the pivot member pivots, the pivot member incorporating a magnet and a shunt, wherein the magnet is located nearer the pivot axis than the shunt, the pivot member having a center of gravity spaced from the pivot axis, and wherein the shunt is mounted radially outwardly of the magnet so as to shield the reed switch from the effect of the magnet when the center of gravity of the pivot member overlies the reed switch, the magnet being positioned sufficiently close to the pivot axis so that rotation of the pivot member about the pivot axis results in actuation of the reed switch.

14. The tilt sensor of claim 13 wherein the magnet is mounted substantially symmetrically about the pivot axis.

15. The tilt sensor of claim 13 wherein the pivot member further comprises:

a base with two upturned opposed arms between which the magnet is mounted, and pivot posts extend from the opposed arms; and a top member partially overlying the magnet and having spring loaded flanges which push down against the magnet and draw at least one locking bar against locking tabs formed on each of the opposed arms.

16. The tilt sensor of claim 15 wherein the base member has transverse notches which reduce the thickness of the base between portions of the base and the upturned opposed arms forming hinges having less thickness then the base.

17. The tilt sensor of claim 15 wherein the base member has two pairs of through thickness notches, each pair of notches reducing the width of the base between portions of the base and the upturned opposed arms forming hinges having less width than the base.

18. The tilt sensor of claim 13 wherein the pivot member comprises a plastic body and a plastic lid and wherein the magnet, a pendulum mass and the shunt are mounted between the plastic body and the plastic lid.

19. The tilt sensor of claim 13 wherein the pivot member further comprises:

a base with two upturned opposed arms between which the magnet is mounted, and pivot posts extend from the opposed arms; and a top member partially overlying the magnet welded to the upturned arms.

20. The tilt sensor of claim 15 wherein the pivot member is formed of two identical mirrored halves, each half having a portion of the base and the top member and one of the upturned opposed arms, the halves being fixed together to contain the magnet.

21. A tilt sensor comprising:

a housing;

a reed switch mounted to the housing;

a pivot member mounted to the housing above the reed switch to pivot about a pivot axis;

a magnet mounted to the pivot member;

a ferromagnetic shunt member mounted to the pivot member, wherein the pivot member is pivotable on the housing about the pivot axis between a first position in which the shunt member is interposed between the magnet and the reed switch, and an activated position in which the shunt member is displaced from the first position such that the magnet activates the reed switch.

22. The tilt sensor of claim 21 wherein the pivot member has a cover which is affixed to a plastic body, the magnet being disposed within a metal stamping positioned over the shunt within the body.

23. The tilt sensor of claim 21 wherein the pivot member has a frame with two axially extending pivot posts, wherein the magnet is positioned within the frame aligned with the pivot posts, and wherein the shunt is spaced from the magnet toward the reed switch, and a counterweight is mounted to the frame above the magnet spaced away from the reed switch.

24. The tilt sensor of claim 21 wherein the pivot member further comprises a plurality of discrete mass segments connected to a frame which contains the magnet, the mass segments being positioned to control the center of gravity and the moment of inertia of the pivot member.

25. The tilt sensor of claim 21 wherein the pivot member has two identical molded metal pieces which are connected together to engage the magnet therein, and wherein the shunt is welded to the connected pieces.

26. The tilt sensor of claim 21 wherein the pivot member has a metal base which interlocks with a top member having spring flanges which press against the magnet, the magnet being held between two spaced upturned arms extending from the base.

27. The tilt sensor of claim 26 wherein the top member has two spaced locking bars positioned on either side of the magnet, and wherein each of the upturned arms has protruding locking tabs, the spring flanges drawing the locking bars against the locking tabs.

28. The tilt sensor of claim 26 wherein the metal base has portions defining two notches where each upturned arm extends from the base to define hinges which have the full thickness of the base.

* * * * *